US009448534B2

(12) United States Patent
Goeller

(10) Patent No.: US 9,448,534 B2
(45) Date of Patent: Sep. 20, 2016

(54) PERPETUAL CALENDAR WITH A DIFFERENTIAL MECHANISM

(71) Applicant: Montres Breguet SA, L'Abbaye (CH)

(72) Inventor: Eric Goeller, Colombier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/867,278

(22) Filed: Sep. 28, 2015

(65) Prior Publication Data

US 2016/0103421 A1 Apr. 14, 2016

(30) Foreign Application Priority Data

Oct. 13, 2014 (EP) ..... 14188600

(51) Int. Cl.
*G04B 19/24* (2006.01)
*G04B 1/00* (2006.01)
*G04B 19/253* (2006.01)

(52) U.S. Cl.
CPC ..... *G04B 19/24* (2013.01); *G04B 1/00* (2013.01); *G04B 19/2536* (2013.01)

(58) Field of Classification Search
CPC ..... G04B 19/24; G04B 19/247; G04B 19/24306; G04B 19/253; G04B 19/25306; G04B 19/2532; G04B 19/25333; G04B 19/2534; G04B 19/25353; G04B 19/2536; G04B 1/00
See application file for complete search history.

(56) References Cited

U.S. PATENT DOCUMENTS

2005/0018542 A1 1/2005 Dias
2005/0078558 A1 4/2005 Dalloz
2005/0232085 A1* 10/2005 Scheufele ..... G04B 19/2536 368/37
2007/0189122 A1 8/2007 Golay
2008/0106979 A1* 5/2008 Bron ..... G04B 19/25 368/34
2012/0213038 A1* 8/2012 Schmidt ..... G04B 19/2536 368/37
2012/0243381 A1* 9/2012 Goeller ..... G04B 27/005 368/34

(Continued)

FOREIGN PATENT DOCUMENTS

CH 660 440 G A3 4/1987
EP 1 349 020 A1 10/2003
EP 1 524 564 A1 4/2005

(Continued)

OTHER PUBLICATIONS

European Preliminary Search Report issued Aug. 5, 2015 in European Application 14188600.2, filed on Oct. 13, 2014 (with English Translation).

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A perpetual calendar for a watch including a movement controlling the daily release, at the moment that the date changes, of a mechanism actuating a perpetual lever of this perpetual calendar is disclosed. The perpetual calendar includes a calendar mechanism, a daily countdown mechanism including a month-end adjustment mechanism, and a differential mechanism. The calendar mechanism is arranged to determine the duration of the current month and is updated at each current month change by the daily countdown mechanism. The differential mechanism is arranged to control, each day at the moment that the date changes, the motion of an additional adjustment cam comprised in the month-end adjustment mechanism, based on the current day of the month taken from the daily countdown mechanism, and also based on the current month duration taken from the calendar mechanism.

8 Claims, 10 Drawing Sheets

(56) References Cited

U.S. PATENT DOCUMENTS

2012/0243382 A1* 9/2012 Goeller ..... G04B 19/2536 368/38
2013/0201801 A1* 8/2013 Calabrese ..... G04B 19/25 368/34
2013/0329531 A1* 12/2013 Nguyen ..... G04B 19/202 368/37

FOREIGN PATENT DOCUMENTS

EP 1 818 738 A2 8/2007
EP 2 503 411 A1 9/2012

* cited by examiner

D1
D2
D3
D4
D5
Rm
A29
A30
A31
Ao
100
300
400
500
600
700
912
412
131
512

PERPETUAL CALENDAR WITH A DIFFERENTIAL MECHANISM

This application claims priority from European Patent Application No. 14188600.2 filed on Oct. 13, 2014, the entire disclosure of which is hereby incorporated herein by reference.

FIELD OF THE INVENTION

The invention concerns a perpetual calendar mechanism for a timepiece including a timepiece movement arranged to control the daily release, at the moment when the date changes, of a mechanism actuating a perpetual lever comprised in said perpetual calendar mechanism.

The invention also concerns a timepiece mechanism including a timepiece movement arranged to control the daily release, at the moment that the date changes, of a mechanism actuating a perpetual lever comprised in such a perpetual calendar mechanism, and comprising a display mechanism including at least date display means controlled by said calendar mechanism.

The invention also concerns a timepiece including such a timepiece mechanism.

The invention concerns the field of calendar display mechanisms in mechanical watches, and more particularly perpetual calendar displays.

BACKGROUND OF THE INVENTION

The most conventional date timepieces are described in particular in the work entitled "Les montres compliquées" (*A Guide to Complicated Watches*) by Francois Lecoultre and edited by Editions Horlogères in Bienne.

In an instantaneous date mechanism, star-wheels for the days of the week, the month of the year and the date are all actuated by the same perpetual lever, which is pivotally mounted relative to the plate or to a bridge of the timepiece movement, and which accomplishes its date change function when the day changes, in an abrupt motion, at a precise moment, by the action of a beak and two clicks, comprised in said perpetual lever. This jump is performed around midnight.

This perpetual lever is returned by a spring to a rest position where one of its beaks abuts on a first sector of a month cam, carried by a month star-wheel with 12 teeth which completes one revolution per year, or a star-wheel with forty-eight teeth completing one revolution in four years. The radius of this month cam is representative of the number of days in the month concerned, either in the form of a notch of greater or lesser depth, or in the form of a portion that protrudes to a greater or lesser extent.

This perpetual lever is made to pivot abruptly by a wheel, which is connected to the movement and completes one revolution in 24 hours, carrying a pin for driving a heart-piece against a roller mounted on a lever returned by a spring. When the heart-piece passes a tip, this triggers the abrupt motion of a finger which drives a beak of the perpetual lever.

During its pivoting motion, the perpetual lever moves away from the month cam, and returns to abut thereon at the end of its motion, either in the same position, if pivoting occurs during the month, or to abut on the sector next to the first sector of the month cam, if the latter pivoted when actuated at the time of a change of date.

Another beak of the perpetual lever controls the pivoting of a day-of-the-week star-wheel. Since the sequence of days is perpetual, no particular mechanism is required, since it is sufficient to increment the position of this star wheel by one step.

The pivoting of a thirty-one star-wheel with thirty-one teeth is achieved via a first thirty-one click, which is pivotally mounted on the perpetual lever and whose pivoting is limited by a pin fixed to said lever. This thirty-one star-wheel pivots integrally with a first cam and a second cam both of which are snails.

The first snail cam is arranged to cooperate with a first feeler-spindle comprised in a pivoting month lever, returned towards said first cam by a spring. The function of this first cam is to cause the month lever to drop at the appropriate time. The month lever includes for this purpose, opposite the feeler-spindle, a second feeler-spindle arranged to cooperate with the month star-wheel with 12 teeth, and to push said month star-wheel by one tooth when the feeler-spindle drops from the large radius to the small radius of the snail.

The second snail cam includes a single notch, against which a second click acts, called the month-end adjustment click, carried by the perpetual lever, and rests thereon via a spring, and this second click only functions for months of less than 31 days.

At the end of a February with 28 days, the beak of the perpetual lever is in the deepest notch of the month cam, and, during the change from the 27th to the 28th of the month, the second click engages in the notch of the second snail cam. This particular setting of the perpetual lever allows the second click to drive four teeth of the thirty-one star wheel together, when the perpetual lever jumps around midnight on the 28th of the month. Simultaneously, the first snail cam actuates the pivoting of the month lever, which drives the month star wheel, and thus the month cam, to pass to the sector for the next month, which in this case is March. Consequently, the perpetual lever takes a new rest position during the month of March, which is such that the drop of the second click is delayed by four days. Thus, from the 28th March to the 1st April, this second click only drives one tooth of the thirty-one star wheel at a time.

Likewise, the notch of the month cam for the months of thirty days is arranged so that the second click drives two teeth of the thirty-one star wheel on the evening of the 30th of the month.

Likewise, the notch of the month cam for the months of February with 29 days in leap years is arranged so that the second click drives three teeth of the thirty-one star wheel on the evening of the 29th of the month.

This tried and tested system requires two clicks to ensure the proper operation of the instantaneous perpetual date mechanism.

CH Patent Application No. 660440A3 in the name of DUBOIS & DEPRAZ SA discloses a perpetual calendar mechanism which includes a large lever driven by the movement and which includes five fingers and one click. This click abuts on the periphery of a snail cam fixed to a thirty-one day wheel. Said wheel carries an actuating finger able to cooperate with a forty-eight month wheel. A first finger, formed by one end of the lever, is located on the path of an actuating finger, which can be driven by a pin carried by the twenty-four hour wheel. This actuating finger carries a convex dorsal part forming a cam, which actuates said perpetual date mechanism. In leap years, a finger enters into contact with a lever comprised in a leap year cam. A third finger cooperates with a twelve month cam. A fourth finger forming a drive beak cooperates with the toothing of a thirty-one day wheel carrying the snail cam, said fourth finger works every day, whereas the click carried by the lever only works at the ends of the months. A fifth finger forming a second drive beak cooperates with a seven day star wheel. Due to this construction, disruptions are different depending on whether they occur for days with one jump (from 1st to 27th) or days with several jumps (28th to 31st). Consequently the torque is used irregularly and the behaviour of the mechanism differs according to the length of the month in progress.

EP Patent Application No 2503411 in the name of MONTRES BREGUET SA describes a calendar mechanism for a timepiece, which includes a movement arranged to control, once a day, the pivoting motion of a perpetual lever comprised in said calendar mechanism, said mechanism comprising means for of driving a perpetual twelve cam, which includes twelve sectors for the successive months, of different radial dimensions according to the duration of each month, and which completes one revolution per year, characterized in that said mechanism has a single click and includes a single click finger, hinged to said perpetual lever and arranged to cooperate directly with a toothing comprised in a thirty-one ratchet wheel which pivots integrally about a pivot axis of a thirty-one snail cam directly or indirectly controlling a calendar display means, and a second cam determining the position of a countdown mechanism arranged to adjust the duration of cooperation between said click finger and said wheel according to the current month and the current day of the month and to determine each day the number of teeth of said wheel to be actuated, and said countdown mechanism measuring the duration of the current month on said perpetual twelve cam and according to the position of a pin comprised therein, allowing, limiting or preventing the cooperation between a beak of said click finger and said thirty-one ratchet wheel.

EP Patent Application No 1349020 A1 in the name of ROGER DUBUIS discloses a calendar timepiece with a large format display and instantaneous jump mechanism, including a time indicator train, and calendar wheel set including a wheel with thirty-one teeth, a units wheel with thirty teeth plus a space corresponding to one tooth for driving a units pinion with ten teeth and a wheel with four teeth for driving a tens star-wheel with four teeth, an annual cam integral with a wheel with twelve teeth, and drive means connected to the time indicator train for driving the calendar wheel set by one revolution per month and the annular cam by one revolution per year, in which the calendar wheel set is integral with a correction element, and the drive means include an instantaneous jump cam integral with a wheel connected to the time indicator train to complete one revolution per day, a drive lever equipped with a retractable drive finger, elastic means pressing said drive lever against the instantaneous jump cam, a correction lever including a retractable drive finger in mesh with said correction element, a feeler-spindle intended to detect the position of said annual cam, and elastic means for connecting these levers to each other, to place the retractable drive finger of the correction lever selectively in mesh with the correction element as a function of the annual cam position detected by the feeler.

EP Patent Application No EP1524564 A1 in the name of ROTH & GENTA describes a timepiece including an annual or perpetual calendar display mechanism, including at least one month cam wherein the mechanism further includes a movable element for indicating the number of days in the month, which can be moved with respect to at least one fixed indicator element and a connection for connecting said movable indicator element to the month cam, so that, during each month, this movable element for indicating the number of days in the month occupies, with respect to the fixed indicator element, a position characteristic of that of the month cam.

SUMMARY OF THE INVENTION

The invention proposes to create an extremely reliable perpetual calendar mechanism, that is easy to insert in place of a conventional calendar mechanism, with few structural modifications.

To this end, the invention concerns a perpetual calendar mechanism for a timepiece according to claim 1.

The invention also concerns a timepiece mechanism according to claim 7.

The invention also concerns a timepiece including such a timepiece mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figures 1, 2:
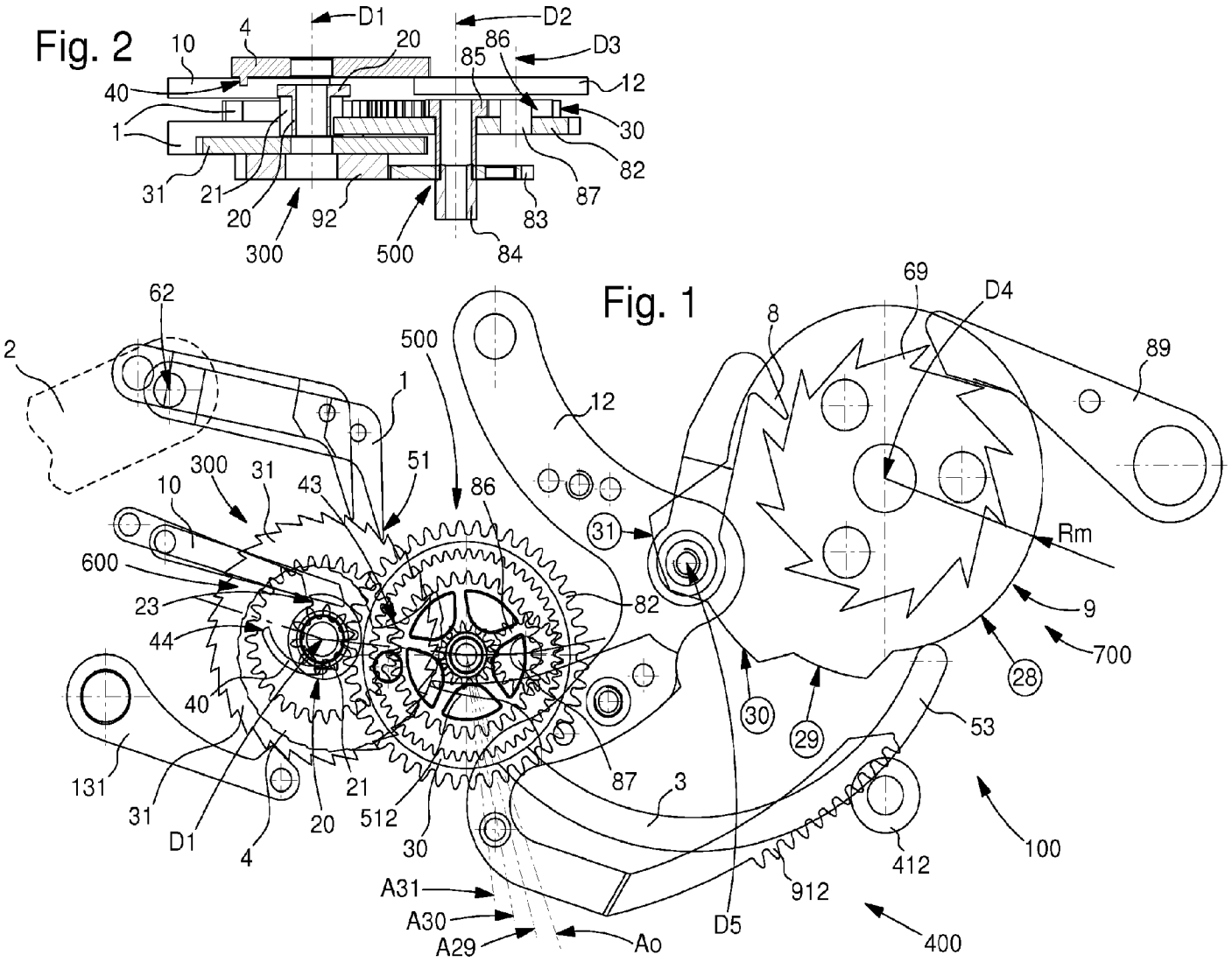
FIG. 1 shows a schematic top view (with a transparent left portion of the Figure illustrating a countdown mechanism cooperating with a differential mechanism) of a perpetual calendar mechanism according to the invention, where operating fingers are shown in two positions, at rest and actuated.
FIG. 2 shows a schematic partial cross-sectional view of a detail of the mechanism of FIG. 1, around a day axis and around a differential axis.
Figure 3:
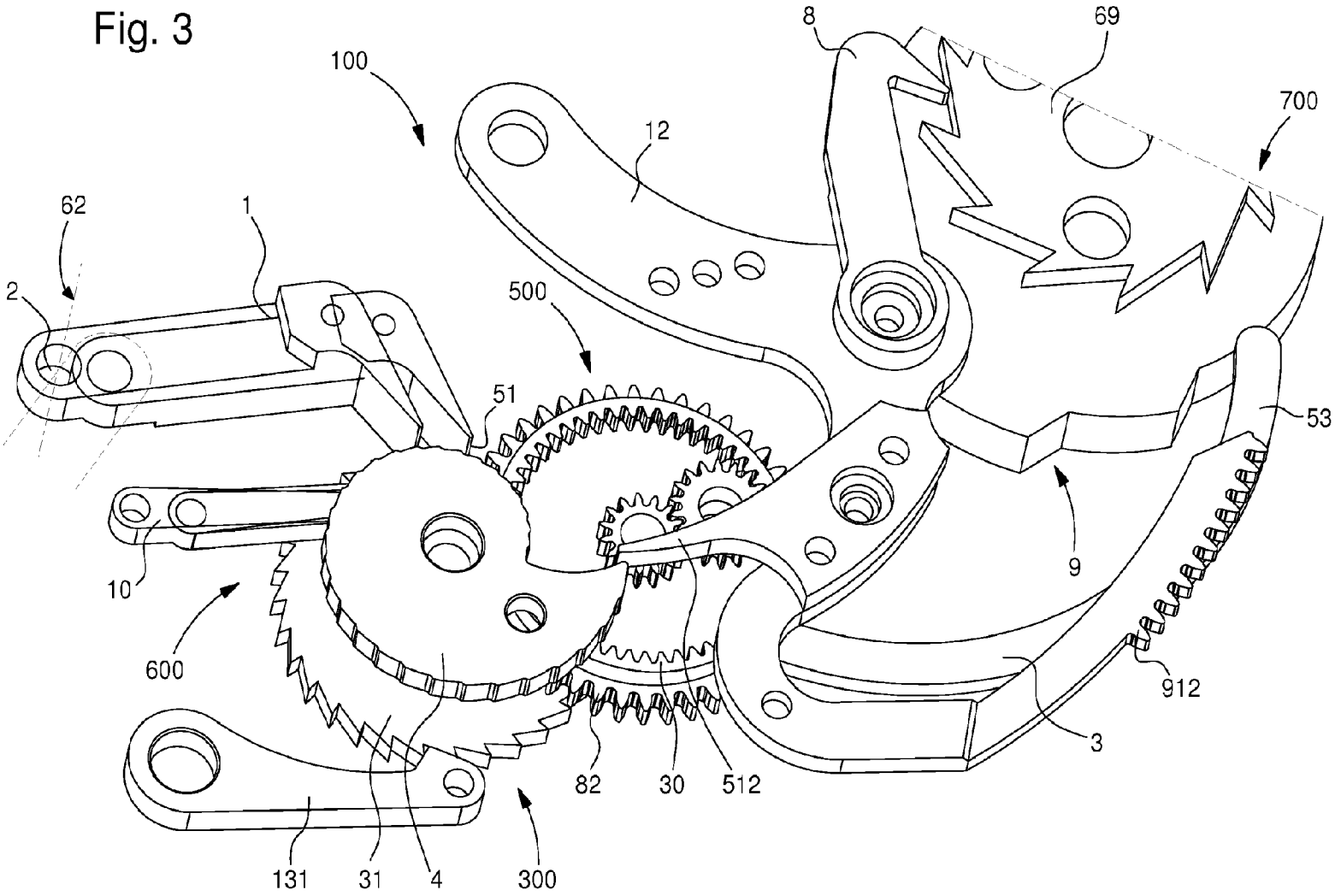
FIG. 3 shows a schematic, partial, perspective, top view of the mechanism of FIG. 1.
Figure 4:
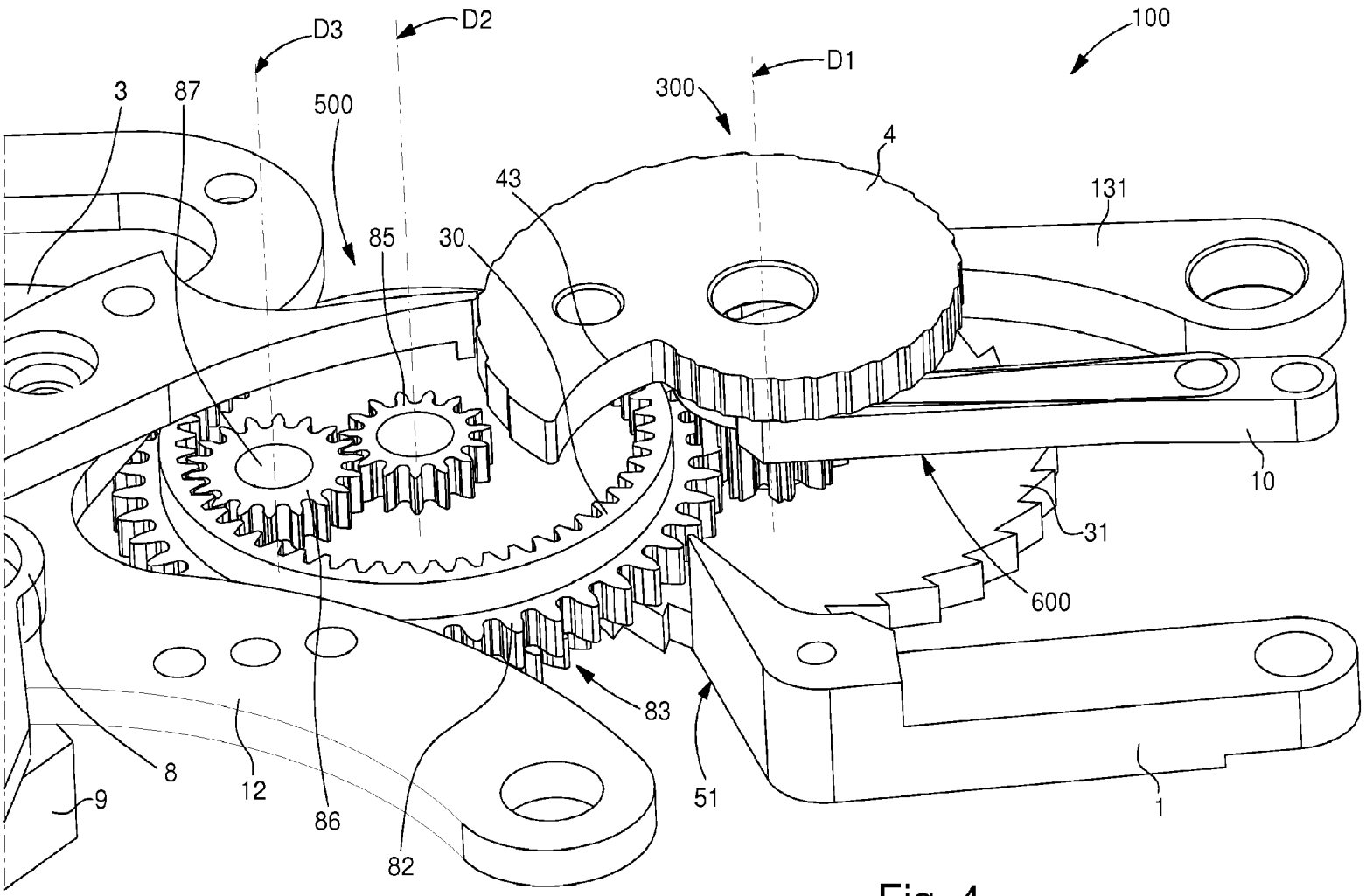
FIG. 4 is a similar view to FIG. 3, but rotated through 180°.
Figure 5:
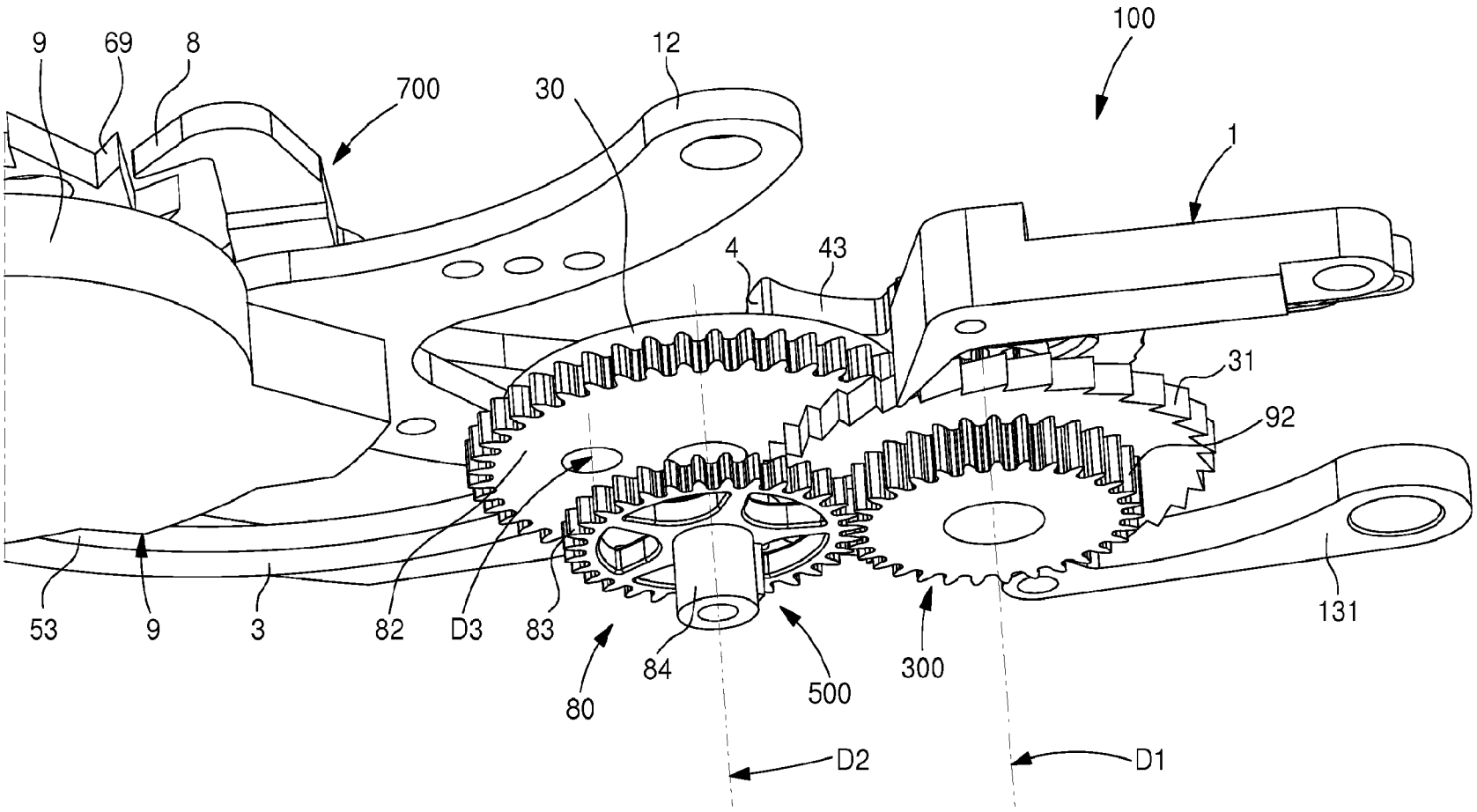
FIG. 5 shows a schematic, partial, perspective, bottom view of the mechanism of FIG. 1.
Figure 6:
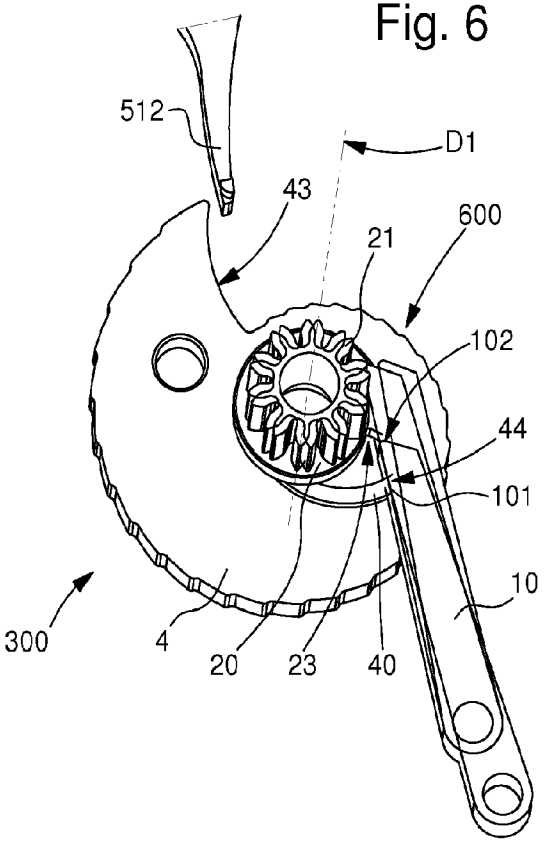
FIG. 6 shows a schematic, partial, perspective, bottom view of a detail of the countdown mechanism including a month-end adjustment mechanism, comprised in the mechanism of FIG. 1.

The invention presents a date mechanism which is easier to arrange in a timepiece than known mechanisms, and in particular so that this mechanism can be arranged in a peripheral area of the watch, less congested by the complications.

The invention is applicable to a calendar display that may or may not be retrograde or instantaneous.

It is devised to be easily incorporated in an existing mechanism, to convert an ordinary date mechanism into a perpetual calendar mechanism.

The invention concerns a perpetual calendar mechanism 100 for a timepiece 1000, which includes a timepiece movement 200 controlling the movement of this perpetual calendar mechanism 100.

This perpetual calendar mechanism 100 includes various lifting-levers and other levers, the form of which is shown merely by way of illustration here, and which is essentially dictated by the other complications comprised in the timepiece, and by the requirement to prevent any interference, which may result in more complex forms than required for the actual functions.

Likewise, it should be understood that the invention can be adapted to any desired periodicity. Those skilled in the art know how to transpose the daily periodicity set out in detail here to other time periods. Likewise, the invention may be used for particular calendars, by replacing the control members described herein, which have 12 months per year of 28 to 31 days, with other control members having a number of different periods, and amplitudes of different duration, for example for lunar or other calendars.

In a known manner, notably from EP Patent Application 2503411 by the same Applicant, whose content is incorporated herein by reference, movement 200 is arranged to cause, once per day, a pivoting motion of a perpetual lever 2, comprised in perpetual calendar mechanism 100. In a preferred embodiment, as shown in the Figures, perpetual calendar mechanism 100 includes a mechanism for adjusting the duration of the month of February for normal or leap years, or, in another variant, additionally, for common end-of-century years.

Perpetual calendar mechanism 100 according to the invention combines a calendar mechanism 700 arranged to determine the duration of the current month, and which is updated at each current month change by a daily countdown mechanism 300, and a differential mechanism 500 which is arranged to control, each day at the moment that the date changes, the motion of the daily countdown mechanism 300 based on information taken both from daily countdown mechanism 300 and from calendar mechanism 700.

More specifically, the perpetual calendar mechanism 100 includes a calendar mechanism 700, a daily countdown mechanism 300 which includes a month-end adjustment mechanism 600, and a differential mechanism 500, wherein the calendar mechanism 700 is arranged to determine the duration of the current month and is updated at each current month change by daily countdown mechanism 300, and wherein the differential mechanism 500 is arranged to control, each day at the moment that the date changes, the motion of a wheel set of the month end adjustment mechanism 600, based on information on the current day of the month taken from daily countdown mechanism 300, and information on the current month duration taken from calendar mechanism 700.

Figure 13:
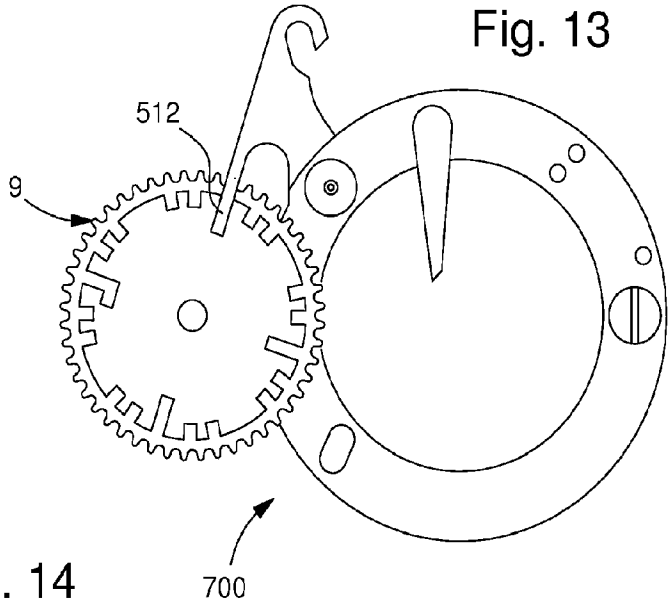
FIG. 13 is a plan view of a four year cam with 48 sectors.
Figure 14:
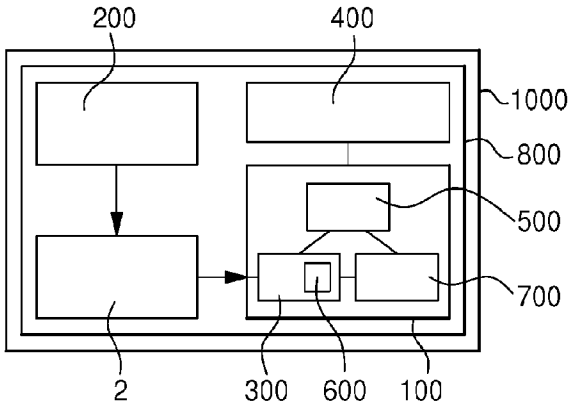
FIG. 14 is a block diagram showing a timepiece, notably a watch, including a timepiece mechanism which in turn includes a timepiece movement and one such perpetual calendar mechanism.
Figure 7:
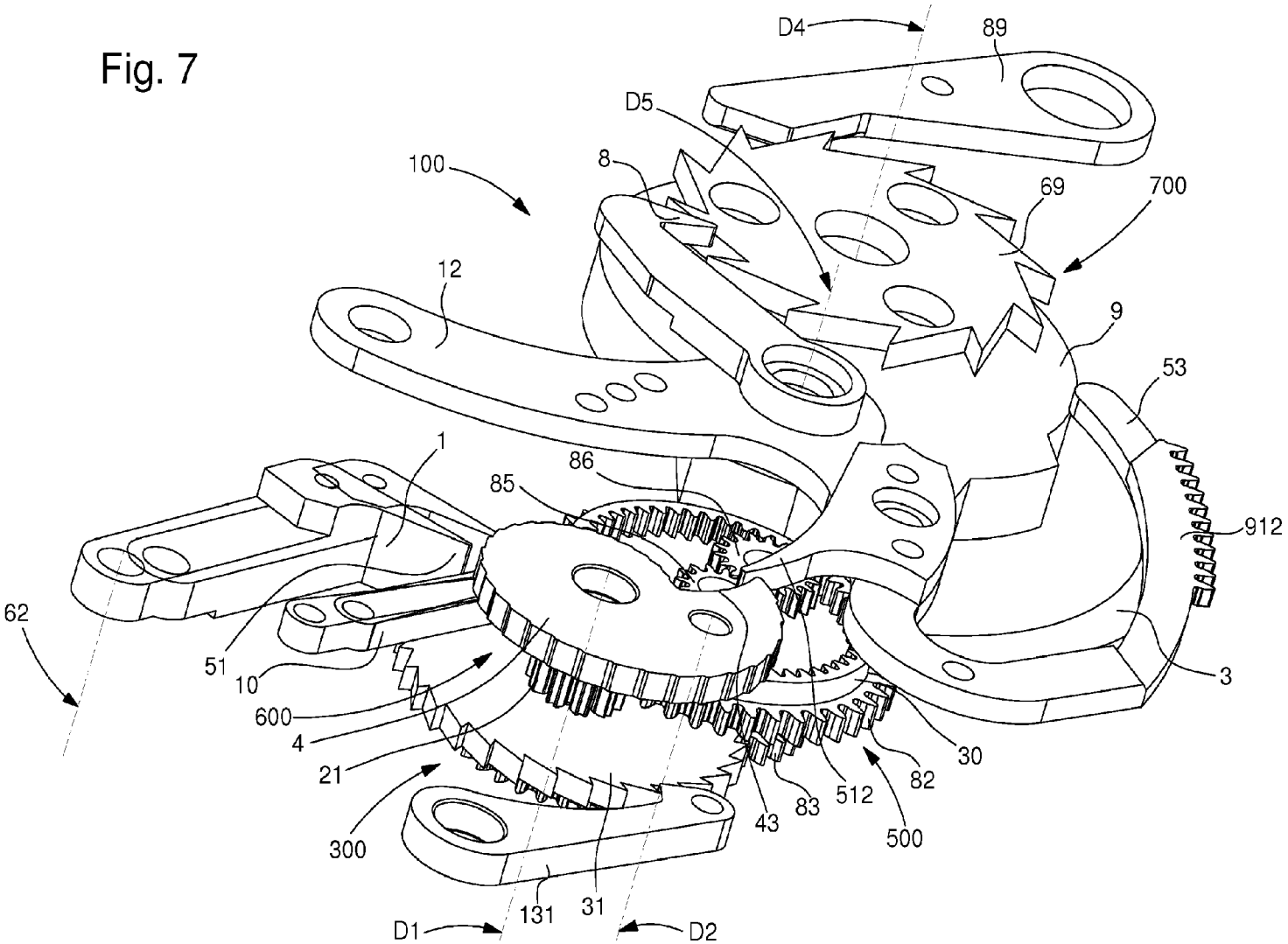
FIG. 7 is a similar view to FIG. 3, from a different angle.
Figure 8:
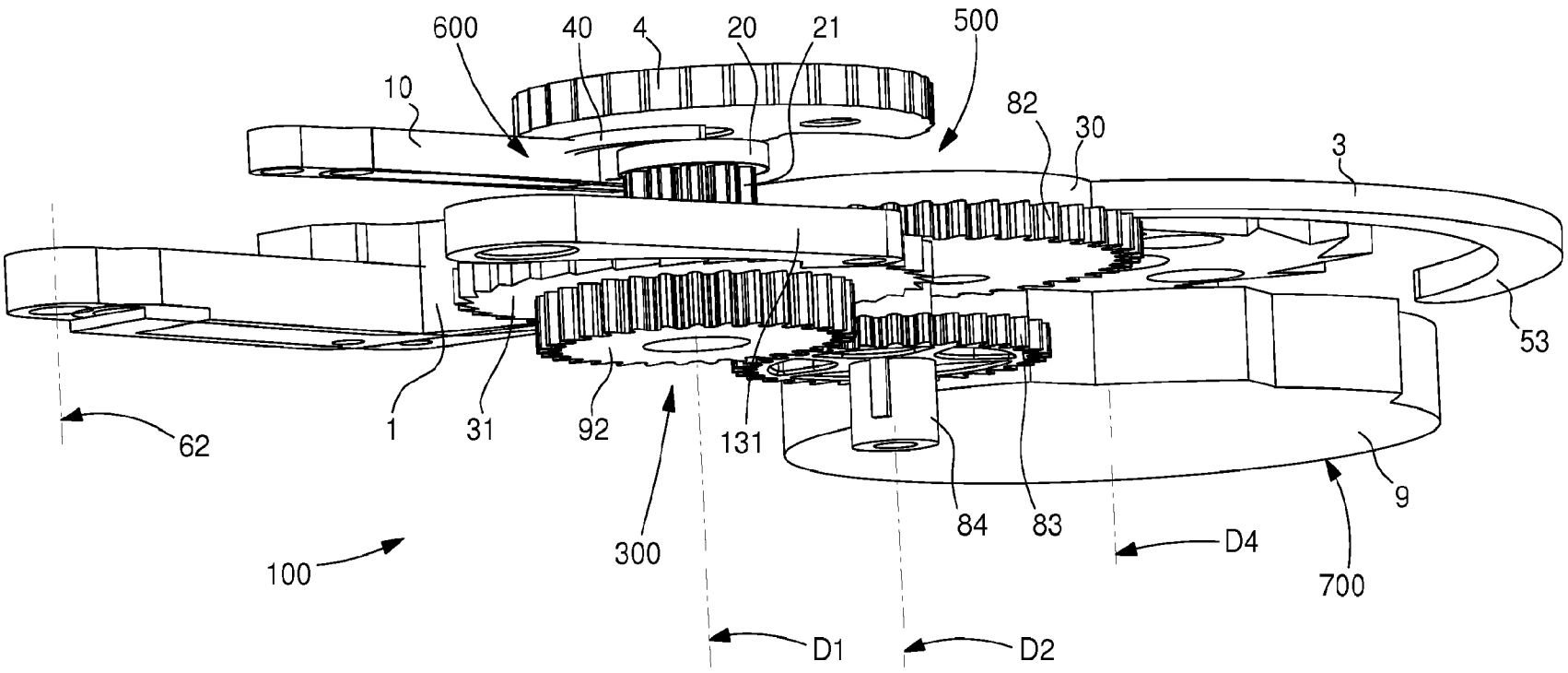
FIG. 8 is a similar view to FIG. 5 but rotated through 180°, and from a different angle, close to a side view.
Figure 9:
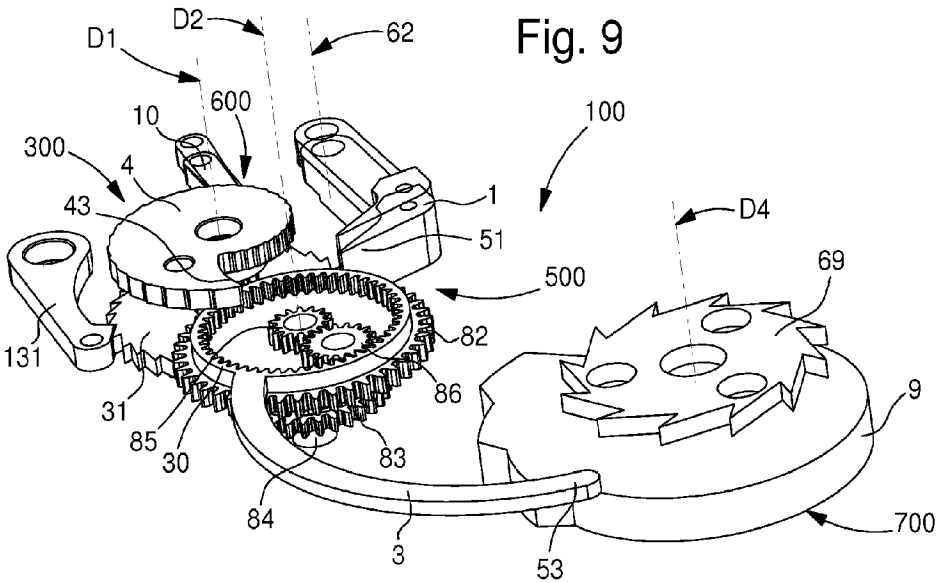
FIG. 9 is a similar view to FIG. 7, from another angle and after removal of a lifting-lever.
Figure 10:
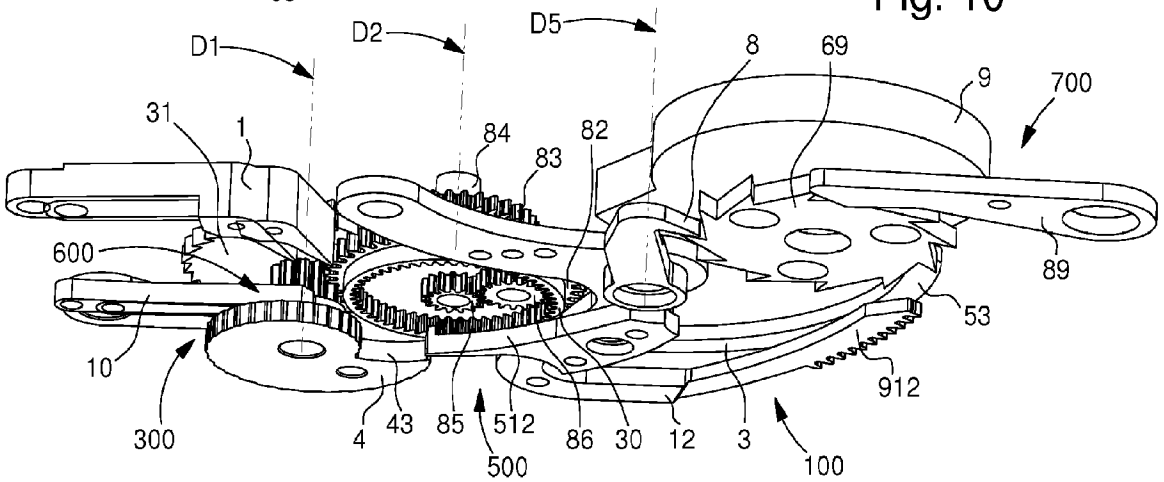
FIG. 10 is a similar view to FIG. 7 from at a different angle.
Figure 11:
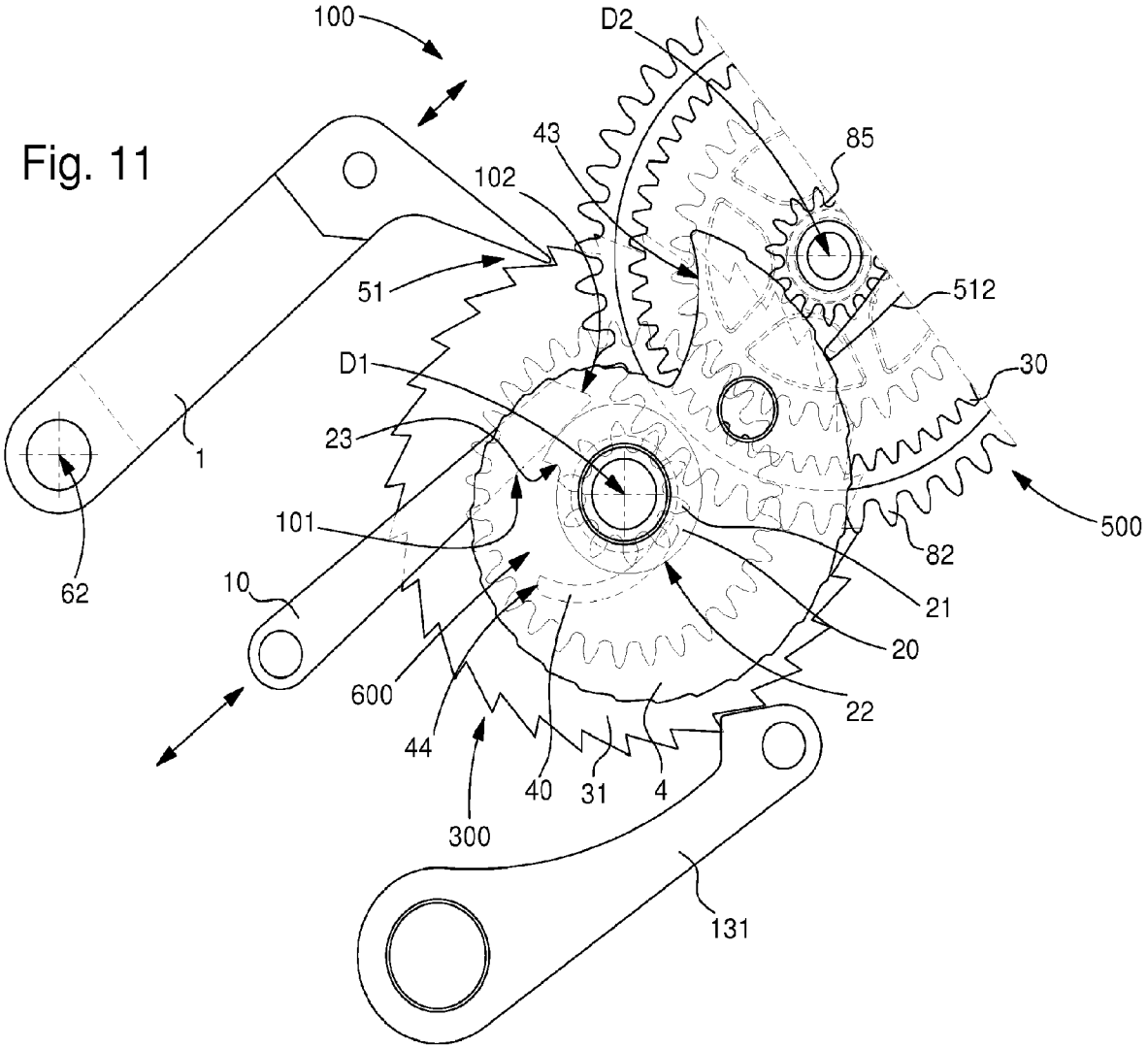
FIG. 11 is a similar top view to FIG. 6, in another relative angular position of the cams of the month-end adjustment mechanism and of the daily countdown mechanism comprised in the mechanism of FIG. 1.

Calendar mechanism 700 preferably includes the usual components, and in particular a perpetual twelve cam, referred to hereafter as the "month cam" 9, which pivots about a month axis D4 and which can adopt several different forms:

- either, as shown in FIGS. 1 to 12, a cam including twelve sectors corresponding to the successive months and of different radial dimensions according to the duration of each month, which makes one revolution per year, and which is combined with a leap year cam 79 carried by the cam, to determine the duration of the month of February in the current year;
- or, as seen in FIG. 13, a four year cam which includes 48 sectors corresponding to the successive months over a period of four years including a leap year;
- or another form.

This month cam 9 is driven by the perpetual calendar mechanism 100 itself, as will be explained hereinafter, and completes one revolution per year.

In a variant using a leap year cam, month cam 9 is coaxial on month axis D4 with a leap year wheel having four teeth, and with a ratchet wheel having twelve teeth. Month cam 9 carries the leap year cam, such as a Maltese cross or similar, the pivoting of which is controlled by the leap year wheel with four teeth. The assembly formed by month cam 9 and the leap year wheel carries or drives a month display indicator.

Month cam 9 pivots integrally with a month ratchet 69, which is held in position by a jumper spring 89. The month cam 9 seen in the Figures, is a simplified didactic representation illustrating a series of different paths corresponding to durations of 28/29/30/31 days, shown encircled in FIG. 1. Naturally, calendar mechanism 700 may incorporate a conventional month cam, with the normal sequence of months and month duration adjustment.

Calendar mechanism 700 also includes, in a known manner, a lifting-lever 12 which pivots about an axis D5, and which is returned by a spring (not shown in the Figures). This lifting-lever 12 carries a feeler-spindle 512 which follows the profile 42 of a date snail cam, referred to here as the "thirty-one cam" 4, comprised in daily countdown mechanism 300, which will be described in detail below. This feeler-spindle 512 is arranged to perform an abrupt jump, at each change of month, under the action of thirty-one cam 4, upon the passage of a radial ramp 43 comprised in its profile 42. This lifting-lever 12 also carries a hook 8, which is arranged to exert traction, at the change of month, on month ratchet 69, to cause it to advance by one step.

This lifting-lever 12 also carries a rack 912 for operating a calendar display indicator 412, forming part of display means 400 of timepiece 1000.

Lifting-lever 12 thus continuously displays the date, its feeler-spindle 512 resting on the periphery of thirty-one cam 4. At the end of the month, feeler-spindle 512 jumps over a radial ramp 43 of thirty-one cam 4, which causes a pivoting motion of month ratchet 69, at the maximum travel of lifting-lever 12 about its axis D3, in order to exert traction. The pivoting of month ratchet 69 causes the pivoting of month cam 9 which is integral therewith.

Daily countdown mechanism 300 includes, at the interface with a timepiece movement 200, a perpetual lever 2. Perpetual lever 2 pivots with respect to the plate or a bridge of timepiece 1000, and movement 200 causes, once per day, an abrupt pivoting of perpetual lever 2, which is returned by a spring to a rest position when it is not driven by movement 200.

In a particular embodiment, perpetual calendar mechanism 100 is an instantaneous date mechanism by means of the abrupt daily action, at midnight, of an instantaneous mechanism arranged to cause the instantaneous pivoting of perpetual lever 2.

In a first example of kinematics, the daily cooperation of perpetual lever 2 with a finger of a twenty-four hour wheel of movement 200 pivots the lever once per day, one of the arms thereof actuating a seven star-wheel positioned by a jumper spring, for the display of the day of the week.

In second example of kinematics, the instantaneous mechanism includes a barrel which carries a plurality of pins, each arranged to interact with a feeler finger comprised in the perpetual lever, in order to pivot said lever instantaneously. Thus, perpetual lever 2 pivots, each day at midnight, under the action of a pin that acts on the feeler finger of perpetual lever 2. Thus, the invention frees the period from 2200 hours to 2400 hours, which is usually reserved for changing the date in calendar timepieces, and during which other operations are not recommended or prohibited.

The daily countdown mechanism 300 includes a main finger 1, which is hinged, at a pivot 62, to one end of perpetual lever 2. This main finger 1 is arranged to cooperate, during the daily pivoting of perpetual lever 2, with a toothing comprised in a ratchet wheel, referred to as the "thirty-one ratchet wheel" 31. This thirty-one wheel 31 pivots integrally about a day axis D1, with a thirty-one snail cam 4. Main finger 1 is returned by a spring (not shown in the Figures).

Each day, main finger 1 rotates thirty-one wheel 31 by one step, via a beak 51 comprised therein, until the 28th of the month. At the end of the month, the correction varies depending on the current displayed month.

In a particular embodiment, main finger 1 is curved between pivot 62 and its beak 51.

Main finger 1 always has the same travel.

In a particular and preferred variant, thirty-one wheel 31 is a non-retrograde wheel that rotates continuously, the invention can then be used for a retrograde or non-retrograde calendar. In the case of a retrograde display, this function is performed downstream of thirty-one wheel 31.

As explained above, the thirty-one cam 4 has snail-shaped periphery, with a radial ramp 43. Feeler-spindle 512 of lifting-lever 12 feels, each day, the position of the day on this outer periphery, and the rotation of lifting-lever 12 updates date display indicator 412.

According to the invention, to determine every day the number of teeth of thirty-one wheel 31 that require actuation, daily countdown mechanism 300 includes a month-end adjustment mechanism 600, which is arranged to adjust the duration of cooperation between main finger 1 and thirty-one wheel 31 as a function of the current month and the current day of the month.

This month-end adjustment mechanism 600 includes, in a particular non-limiting embodiment, seen in FIGS. 1 to 12, an additional cam 20, which is a movable adjustment cam, coaxial with thirty-one cam 4 and with thirty-one wheel 31 about day axis D1, and whose angular deviation varies with respect to thirty-one wheel 31, and determines the number of days adjustment to be made, for months of less than 31 days.

This additional cam 20 is arranged to cooperate with an additional finger 10, comprised in month-end adjustment mechanism 600. This additional finger 10 pivots on perpetual lever 2 which pushes it once per day, in the same manner as main finger 1, and it also always has the same travel.

Thirty-one cam 4 and additional cam 20 are both snail-shaped cams, increasing in the same direction. Each of them includes an steep radial ramp, respectively 42 and 43.

Additional finger 10 is arranged to control the date adjustment at the end of the month, according to the date and duration of the current month, by driving the appropriate number of teeth of thirty-one wheel 31.

Main finger 1 performs the perpetual calendar actuation function, in cooperation with additional finger 10 and thirty-one wheel 31.

The last normal day of each month is the 28th of the month.

On the evening of the 28th, month-end adjustment mechanism 600 must perform certain actions:

- if the month has 28 days, an adjustment of four teeth must be made in order to jump to the first day of the following month, in this case March;
- if the month has 29 days, an adjustment of three teeth must be made in order to jump to the first day of the next month, in this case March;
- if the month has 30 days, an adjustment of two teeth must be made in order to jump to the next month;
- if the month has 31 days, a normal jump of one tooth is made.

Thus the motion ensuring the appropriate jump must be communicated to additional cam 20.

To achieve this, differential mechanism 500 of the invention operates daily countdown mechanism 300 based on information taken both from daily countdown mechanism 300 and from calendar mechanism 700. More specifically, differential mechanism 500 is a differential mechanism arranged to control the angular position of additional cam 20, as a function of the positions of month cam 9 and thirty-one cam 4, or of thirty-one wheel 31, which amounts to the same thing since the last two are integral with each other.

In short, according to the invention, daily countdown mechanism 300 is controlled by a differential mechanism 500 between month cam 9 and thirty-one cam 4.

This mechanism differs from the prior art of the aforecited EP Patent Application Nos 1349020 A1 and 1524564 A1, in that, in the first document a differential mechanism forms a simple multiplier, and in the second, a differential mechanism is concerned only with managing the month of February. In the present invention, differential mechanism 500 controls the motion of movable date adjustment cam 20, each day of each month when the date changes.

To determine the number of days in the current month, perpetual calendar mechanism 100 includes, in differential mechanism 500, a reader lifting-lever 3, which includes a reader feeler-spindle 53 for measuring the duration of the current month on month cam 9.

This reader feeler-spindle 53 is positioned, according to the current month, on a radius Rm with respect to month axis D4. This radius Rm is variable, and depends on the number of days in the month concerned.

At each change of month, the rotation of month ratchet 69 causes the rotation of month cam 9 which is integral therewith, so as to present, facing reader feeler-spindle 53, the radius Rm that corresponds to the next month.

According to the invention, this reader feeler-spindle 3 forms a first input of differential mechanism 500.

This differential mechanism 500 is, in a non-limiting manner, a planetary gear differential. It includes, mounted to pivot about a differential axis D2:

- a main arbor 84, the lower part of which is integral with an axial wheel 83. This axial wheel 83 meshes with a drive wheel 92 coaxial on day axis D1 with thirty-one wheel 31 and integral therewith;
- the upper part of main arbor 84 carries an axial pinion 85;
- a toothed planetary carrier plate 82, mounted for free rotation about a shoulder of main arbor 84. Planetary carrier plate 82 meshes via its toothing with an additional pinion 21 integral with a movable date adjustment cam, said additional cam 20 being mounted to pivot on day axis D1. This additional cam 20 is arranged to cooperate, in certain angular positions thereof, in abutment with additional finger 10;

toothed planetary carrier plate 82 carries, off-centre, a planetary arbor 87;

planetary arbor 87 carries, mounted for free rotation, a planetary pinion 86, which meshes, on the one hand with axial pinion 85 of main arbor 84, and on the other hand with a toothed crown 30;

this toothed crown 30 is integral with reader lifting-lever 3, and forms therewith a component in the form of a digit 6, the end of whose tail is reader feeler-spindle 53. This toothed crown 30 only meshes with planetary pinion 86 which ensures the centring thereof with respect to differential axis D2.

The second input of differential mechanism 500 is formed by thirty-one wheel 31 positioned by main finger 1.

The output of differential mechanism 500 is formed by an additional cam 20, controlled by the induced motion of planetary carrier plate 82.

Differential mechanism 500 is reversible, and the inputs or outputs can be switched. This is the particular case where, when perpetual lever 2 imparts a motion to main finger 1, and to additional finger 10, the latter interferes with additional cam 2, thus imparting a pivoting motion to planetary carrier plate 82, which becomes an input of differential mechanism 500, the output is then axial wheel 83, which drives thirty-one wheel 31 by imparting thereto the pivoting motion required in order to jump the correct number of teeth.

Radial position Rm of reader feeler-spindle 53 thus determines, each month, a particular angular position of toothed crown 30.

The combination of this angular position of toothed crown 30 on the one hand, and of the angular position of axial wheel 83 directly linked to that of thirty-one wheel 31 on the other hand, determines the position of arbor 87 which rolls in toothed crown 30 while meshing with axial wheel 83, and thus determines the angular position of planetary carrier plate 82, and thus of the additional cam 20, which is integral with additional pinion 21, controlled in rotation by planetary carrier plate 82.

In short, the planetary wheel of the differential mechanism takes the information from the month cam, instead of the large lever used for this purpose in conventional perpetual calendar mechanisms.

Additional finger 10 is arranged to drive thirty-one cam 4, in certain angular positions of thirty-one cam 4.

Again, this is to prevent inadvertent corrections being made during the month. To this end, the month-end adjustment mechanism 600 also includes a safety mechanism, arranged, in certain angular positions of thirty-one cam 4 and of thirty-one wheel 31, to allow the access of additional finger 10 to additional cam 20, and in other angular positions of thirty-one cam 4, to prevent the access of additional finger 10 to additional cam 20.

More specifically, in a simple and advantageous embodiment, seen in FIGS. 1 to 11, thirty-one cam 4 includes, projecting over one of the faces thereof, here on the lower part facing thirty-one wheel 31, a deviator element 40 with a particular contour, forming this safety mechanism.

Depending on the angular position of thirty-one cam 4, this deviator element 40 allows or prevents the access of tip 102 of additional finger 10 to profile 22 or to radial ramp 23 of additional cam 20.

Indeed, in certain positions, deviator element 40 repulses the lower surface 101 of additional finger 10, preventing the access thereof to profile 22 of additional cam 20. The axial motion of additional finger 10 imparted by perpetual lever 2 then has no effect on the angular position of additional cam 20, of its additional pinion 21 and of planetary carrier plate 82.

On so-called normal days, from the first to the 27th of the month, other than those at the end of the month, the adjustment finger 10 never meets cam front 23, it slides over the profile of additional cam 20, or on a flat portion of deviator element 40 which is tangential to the external profile of additional cam 20. The deviator element 40 thus moves away adjustment finger 10 to let additional cam 20 rotate in any direction, forwards or backwards, without contact. In the case where front 23 of additional cam 20 moves backwards at the change of month, deviator element 40 thus prevents additional finger 10 making an adjustment during the change to the next day: for example, the date is prevented from being inadvertently changed from the first to the third of the month.

On the days at the end of the month, adjustment finger 10 meets cam front 23 and pushes it; in doing so, it rotates planetary carrier plate 82 of differential mechanism 500, and therefore rotates the ratchet of thirty-one wheel 31; during this thrust, a distal end 44 of deviator element 40, the furthest from day axis D1, moves away adjustment finger 10, which can then no longer catch front 23 of additional cam 20; only main finger 1 can push the ratchet of thirty-one wheel 31, which, in the meantime, has rotated towards its new position which corresponds to the adjustment made.

In short, for several days, adjustment finger 10 is uncoupled by the action of deviator element 40, which prevents it taking any action on additional cam 20.

In the other positions, additional finger 10 may drive profile 22 of additional cam 20, and thus rotate additional pinion 21, thereby driving planetary carrier plate 82.

Figure 12:
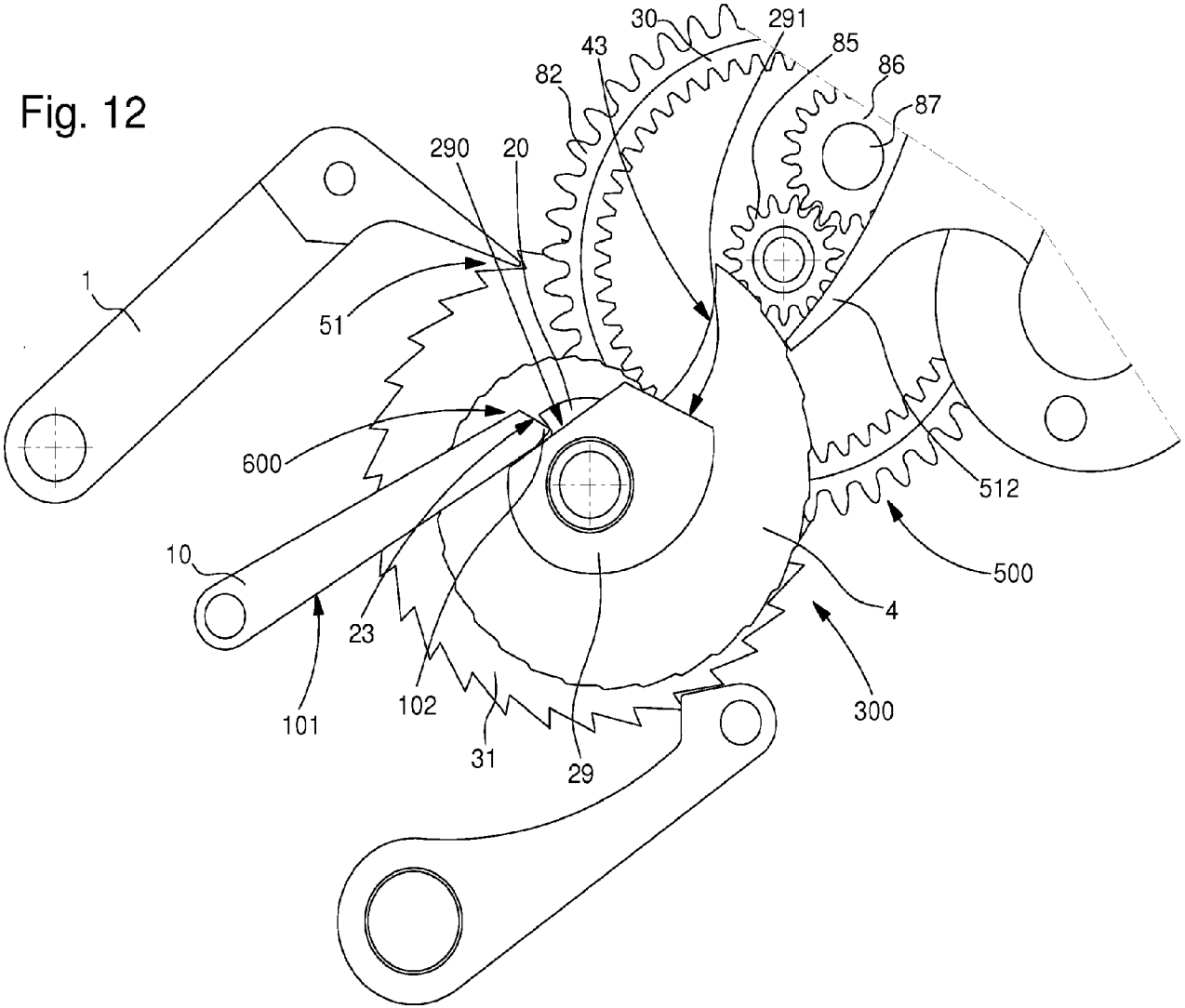
FIG. 12 is a top view of a variant wherein the month-end adjustment mechanism includes a surprise-piece.

In a particular alternative embodiment, illustrated in FIG. 12, the thirty-one wheel 31 is integral with a surprise-piece 29, which forms this safety mechanism, and which, in a non-limiting manner, includes a circular circumference interrupted by two flat portions 290 and 291.

During the daily actuation of perpetual lever 2, main finger 1 and additional finger 10, which were on standby in an advanced position, slide backwards, over the teeth of thirty-one wheel 31 for main finger 1 and, depending on the case, over the periphery of additional cam 20 and/or over deviator element 40 for additional finger 20.

Due to the existence of differential mechanism 500, the angular position of additional cam 20 varies with respect to thirty-one cam 4, since it depends both on the current day, and on the information relating to the duration of the current month taken by reader feeler-spindle 53 from month cam 9. The angular deviation of these fronts 43 and 23 is limited to 4 days, from the date of the 28th.

With respect to a certain angular deviation between the two fronts 43 and 23, which corresponds to a month of 31 days, differential mechanism 500 presents front 23 of additional cam 20 with an angular deviation corresponding to an adjustment jump of two teeth on the ratchet of thirty-one wheel 31, when reader feeler-spindle 53 on month cam 9 is on a 30 day position. This angular deviation corresponds to an adjustment jump of three teeth when reader feeler-spindle 53 on month cam 9 is on a 29 day position, and to an adjustment jump of four teeth when reader feeler-spindle 53 on month cam 9 is on a 28 day position. The jump to the date of the 31st is naturally a jump of one tooth.

The invention also concerns a timepiece mechanism 800 including a timepiece movement 200 arranged to control the daily release, at the moment that the date changes, of a mechanism actuating a perpetual lever 2 comprised in such a perpetual calendar mechanism 100, and comprising a display mechanism 400 including at least date display means 412 controlled by calendar mechanism 700.

The invention also concerns a timepiece 1000, particularly a watch, including at least one such timepiece movement 800.

The invention makes it possible to convert a conventional date mechanism into a perpetual calendar mechanism, without any substantive changes, both with a forty-eight cam and with a twelve cam.

It offers the advantage of limiting the torque draw. Indeed, in known perpetual calendars, the large lever with a double or single click covers a greater or lesser angle to correct the different months, and thus exerts greater or lesser draw on the movement. In particular, for the month of February, a conventional perpetual calendar lever has a large motion for 28 days.

There is also a considerable difference in correction mode: in a conventional perpetual calendar the pusher has to accomplish a large travel in February, and the user may inadvertently mismatch the day and the date.

The mechanism according to the invention makes it possible to prevent any errors of this type, and the user is assured that the date and month displays are accurate, since it is impossible to shift the date between the month cam and the thirty-one wheel. For example, it is impossible for the user to display 30th February or 31st June by manual correction. In some perpetual calendars, the correction is made using only the thirty-one wheel, which means that, for a coupling with a 48 cam, it is necessary to manually perform 47 turns of the thirty-one wheel to return to the correct month on the 48 cam. This advantage is therefore far from insignificant.

It is also possible to perform a correction on the month cam without having to isolate the large lever.

In short, adjustments are facilitated, the travel of the levers is reduced and the mechanism is simple, reliable and compact.

What is claimed is:

1. A perpetual calendar mechanism for a timepiece including a timepiece movement arranged to control a daily release, at a moment that a date changes, of a mechanism actuating a perpetual lever comprised in said perpetual calendar mechanism, wherein said perpetual calendar mechanism includes a calendar mechanism, a daily countdown mechanism which includes a month-end adjustment mechanism, and a differential mechanism, wherein said calendar mechanism is arranged to determine a duration of a current month and is updated at each change of the current month by said daily countdown mechanism, and wherein said differential mechanism is arranged to control, each day at a moment that a date changes, a motion of an additional adjustment cam comprised in said month-end adjustment mechanism, based on information on a current day of the month taken from said daily countdown mechanism, and information on the duration of the current month taken from the calendar mechanism.

2. The perpetual calendar mechanism according to claim 1, wherein said differential mechanism includes a reader lifting-lever, which includes a reader feeler-spindle to measure the duration of the current month on a month cam comprised in said calendar mechanism, and wherein said reader lifting-lever forms a first input of said differential mechanism, a second input of which is formed by a thirty-one wheel comprised in said daily countdown mechanism and which is positioned by a main finger comprised in said daily countdown mechanism, and which is operated each day at the moment the date changes by said perpetual lever, to control at an output of said differential mechanism an angular position of said additional cam.

3. The perpetual calendar mechanism according to claim 2, wherein said month-end adjustment mechanism includes an additional finger which is operated each day, like said main finger, at the moment the date changes by said perpetual lever, and which is arranged to cooperate in abutment with a radial ramp comprised in said additional cam, in certain angular positions of said additional cam.

4. The perpetual calendar mechanism according to claim 3, wherein said month-end adjustment mechanism includes a safety mechanism, arranged, in certain angular positions of said thirty-one wheel, to allow an access of said additional finger to said additional cam, and, in other angular positions of said thirty-one wheel to prevent the access of said additional finger to said additional cam.

5. The perpetual calendar mechanism according to claim 4, wherein said daily countdown mechanism includes a thirty-one cam which rotates integrally with said thirty-one wheel and which cooperates with a feeler-spindle comprised in a pivoting lifting-lever comprised in said calendar mechanism, and wherein said thirty-one cam includes, projecting over one of faces thereof, a deviator element forming said safety mechanism, and which, depending on the angular position of said thirty-one cam, allows or prevents the access of said additional finger to the profile of said additional cam.

6. The perpetual calendar mechanism according to claim 2, wherein said differential mechanism is a planetary gear differential which includes:

a main arbor a lower part of which is integral with an axial wheel which meshes with a drive wheel coaxial on a day axis with said thirty-one wheel and integral therewith, the main arbor mounted to pivot about a differential axis, an upper part of said main arbor carrying an axial pinion;

a toothed planetary carrier plate, mounted for free rotation about a shoulder of said main arbor, said planetary carrier plate meshing via a toothing thereof with an additional pinion integral with said additional cam which is a movable date adjustment cam mounted to pivot on said day axis, and said planetary carrier plate carrying, off-centre, a planetary arbor which carries, mounted for free rotation, a planetary pinion, which meshes, on the one hand, with said axial pinion of said main arbor, and on the other hand with a toothed crown, which is integral with said reader lifting-lever and which meshes only with said planetary pinion which ensures a centring thereof with respect to said differential axis.

7. A timepiece mechanism including a timepiece movement arranged to control the daily release, at the moment that the date changes, of a mechanism actuating a perpetual lever comprised in a perpetual calendar mechanism according to claim 1, and comprising a display mechanism including at least date display means controlled by said calendar mechanism.

8. A timepiece movement including a timepiece mechanism according to claim 7.

* * * * *